United States Patent [19]

Carlsson

[11] 4,103,611

[45] Aug. 1, 1978

[54] STROKE-LIMITING ARRANGEMENT IN A MULTI-CYLINDER HYDRAULIC PRESS

[75] Inventor: Bengt Johan Carlsson, Motala, Sweden

[73] Assignee: A B Motala Verkstad, Motala, Sweden

[21] Appl. No.: 833,035

[22] Filed: Sep. 14, 1977

Related U.S. Application Data

[63] Continuation-in-part of Ser. No. 659,788, Feb. 20, 1976, abandoned.

[30] Foreign Application Priority Data

Feb. 28, 1975 [SE] Sweden ..... 7502302

[51] Int. Cl.[2] ..... B30B 15/16

[52] U.S. Cl. ..... 100/257; 100/269 R

[58] Field of Search ..... 100/257, 269 R

[56] References Cited

U.S. PATENT DOCUMENTS 2,810,930 10/1957 MacDonald ..... 100/257 X

FOREIGN PATENT DOCUMENTS 601,018 7/1960 Canada ..... 100/257

*Primary Examiner*—Billy J. Wilhite

*Attorney, Agent, or Firm*—Oldham, Oldham, Hudak & Weber Co.

[57] ABSTRACT

Apparatus for maintaining the relative spacing of the pressure surfaces in a multi-cylinder press at a predetermined value greater than the desired minimum spacing during the pressing operation, and including liquid supplying means for a press cylinder, a liquid discharge valve and actuating means for mechanically opening the discharge valve when the relative spacing of the press surfaces decreases below a predetermined value. A further control valve adapted, in accordance with a predetermined program, to prevent or allow liquid to be discharged from the cylinder is also present.

6 Claims, 5 Drawing Figures

STROKE-LIMITING ARRANGEMENT IN A MULTI-CYLINDER HYDRAULIC PRESS

CROSS REFERENCE

This is a continuation-in-part of U.S. application Ser. No. 659,788, filed Feb. 20, 1976, now abandoned.

The present invention relates to a simple and reliable stroke-limiting arrangement of great accuracy and capable of being switched in and out at will.

When pressing resilient material, loosely interconnected, resilient mats are compressed between heated press platens or tables in multi-cylinder hydraulic presses so as to be converted into rigid sheets or slabs.

In order to attain a uniform sheet-thickness even if the basic weight of the mats varies, spacer ribs are usually disposed between the press platens so as to extend along the longitudinal edges of the latter, although also other kinds of mechanically acting stroke-limiting arrangements are known to the art.

The drawbacks of the various prior art arrangements are well known to those skilled in the art.

In certain applications, such as, for instance, where it is desired to squeeze out as much water as possible from the mats in a first phase of the pressing operation, the said prior art arrangements prevent compression into a thinner mat thickness than the final sheet thickness, thereby limiting the amount of water which can be squeezed out.

Also, previously known to the art are presses in which a plurality of electric devices, such as limit switches, disposed at the longitudinal sides of the press, are caused to sense the press movements and to control the hydraulic pressure in one or more cylinders, respectively, in the proximity of the respective switches to prevent any predetermined stroke length from being exceeded. Available electrical switching devices possessing the desired sensing accuracy, however, have an output signal which is so weak that it must be amplified in order to be capable of operating the solenoid valve forming the transition between the electrical and hydraulical circuits of the servo control system. Then, frequently, the solenoid valve is incapable of directly controlling the hydraulic pressure in its associated cylinder, so that also hydraulic amplification will have to be resorted to. The number of stages in the servo system has a negative influence on the accuracy at which the stroke length of the cylinders are limited and increases the danger of operation failure. The latter condition is particularly perceptible in presses with large operating surface areas, for instance, 2,5 times 20 meters, where the cylinders and control systems may be up to 20 or 30 in number.

The present invention has for its object to provide stroke-limiting means of great accuracy and which, owing to their simplicity, are reliable in operation, can be switched in and out at will and enable the stroke length to be limited to any desired number of values in any desired sequence during the pressing operation. The invention has been applied to a press having an operating pressure of 15,000 tons and has presented a reproduction accuracy higher than ± 0.05 mm.

The invention will be described more in detail hereinafter as applied, for illustrational purposes, to a single-deck press comprising four cylinders only, and with reference to the accompanying drawings in which.

Figure 1:
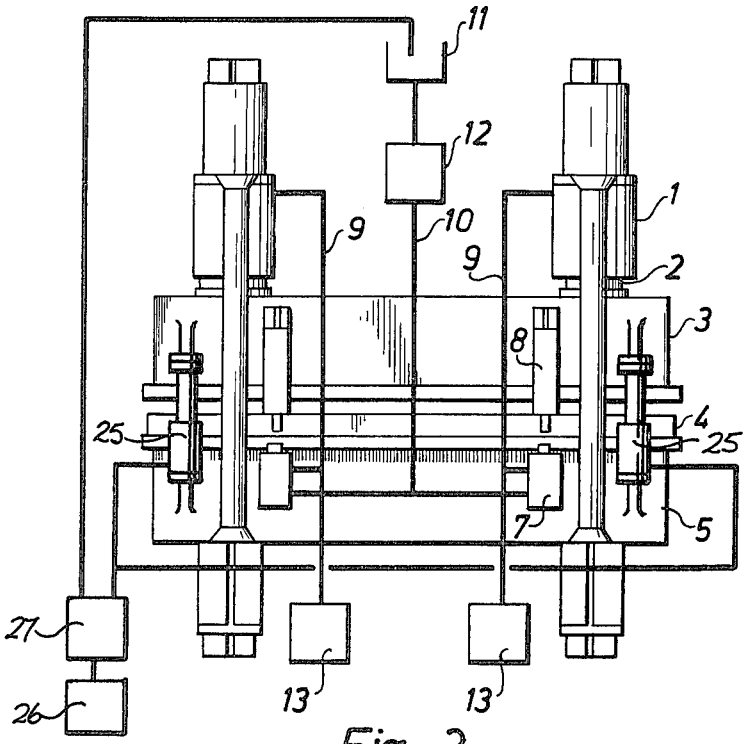
FIG. 1 shows a press in side view.
Figure 2:
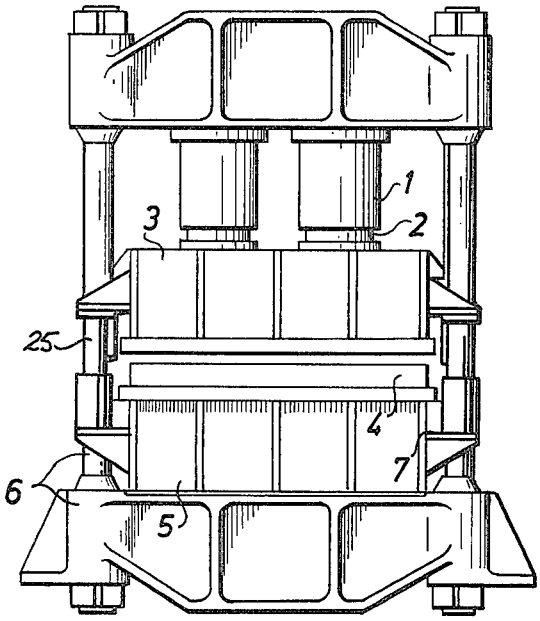
FIG. 2 shows the press in end elevation.

FIGS. 1 and 2 illustrate a press comprising cylinders 1 and associated pistons 2 acting on a movable press table 3 adapted during the pressing operation to press material 4 against a fixed press table 5. The force of reaction from the cylinders 1 and from the fixed press table 5 is taken up by press frames 6. In the vicinity of or near each cylinder 1, a valve 7 is rigidly connected to the lower press table 5. The valves 7 are opened mechanically by actuator devices 8 which are rigidly connected to the movable press table 3 and disposed above the associated valves 7, as the spacing between the press tables 3 and 5 decreases below a certain, predetermined value, and are closed as this value is exceeded. As any valve 7 is opened, its associated cylinder 1 will be connected by pipe conduits 9, 10 to a reservoir 11 arranged in common to all of the cylinders 1. The conduit 10 common to the cylinders 1 comprises a cut-off valve 12 adapted, when in its closed position, to prevent any flow from the cylinders 1 to the reservoir 11. The actuators 8 each has a length which is adjustable during the press molding operation. Associated with each cylinder 1 is a liquid supplying device 13 adapted continuously to supply the cylinders with hydraulic fluid under pressure.

Between the fixed press table 5 and the movable press table 3 hydraulic cylinders 25 are arranged for the return movement of the table 3 and they operatively connect to a pump 26 and a directional valve 27 to provide press opening movement when the pump 26 is actuated.

Figure 3:
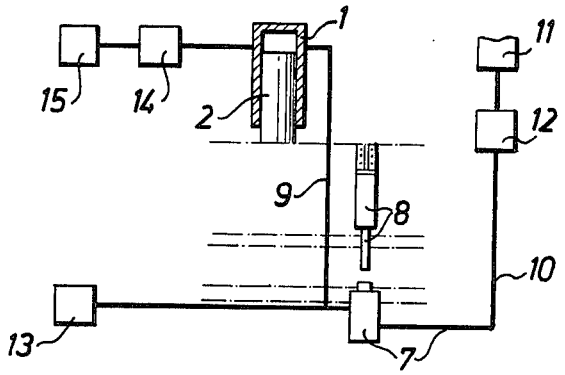
FIG. 3 is a diagrammatic showing of the control circuit for one cylinder.

FIG. 3 illustrates, in respect of one single cylinder, the hydraulic circuitry just described in a diagrammatical form, and how, by means of associated control valves 14, the respective cylinders in common are connected to or, alternatively, disconnected from a hydraulic system 15, of a conventional kind for closing the press, increasing its operating pressure, reducing its operating pressure and, finally, opening the press; but usually the press closing movement is controlled by the pump 26 and valve 27 as described.

The pressure generating part of the hydraulic system comprises a pump and usually an accumulator for hydraulic fluid and valves for their connecting and disconnecting, but such part is not shown in detail. Before the opening of the press at the end of the press cycle, the cylinders 1 are suitably operably connected to the reservoir 11 for lowering of the pressure and the return flow of the hydraulic flow as the return movement of the table 3, i.e. opening of the press occurs. For the return movement of the table, the return cylinders 25 are connected to the associated pressure generating part of the hydraulic system.

The valve 14, FIG. 3, is controlled either by the position of the press table, the time or a combination of these parameters. The pump 13 is working continually during the pressing.

Figure 4:
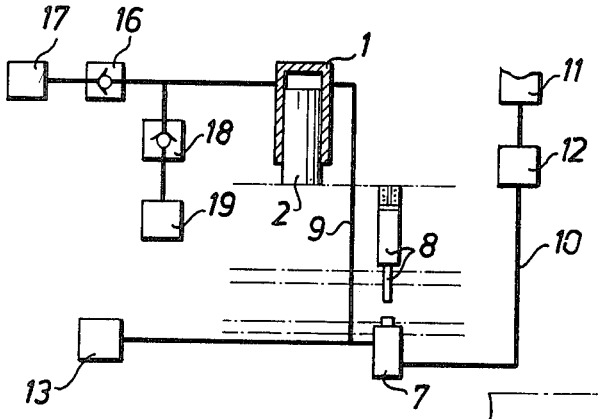
FIG. 4 is an alternative form of the control circuit of FIG. 3.

FIG. 4 illustrates an alternative to the embodiment illustrated in FIG. 3. In this case the cylinders, through individual first non-return valves 16, are connected to a common pumping station or pump 17 for effecting closing and pressure increase, and are connected through individual second non-return valves 18 to a common valve system 19 for effecting pressure reduction and opening. The pump 13 is working constantly, but is can only generate a pressure in the cylinder 1 when the drain 19 is closed.

Figure 5:
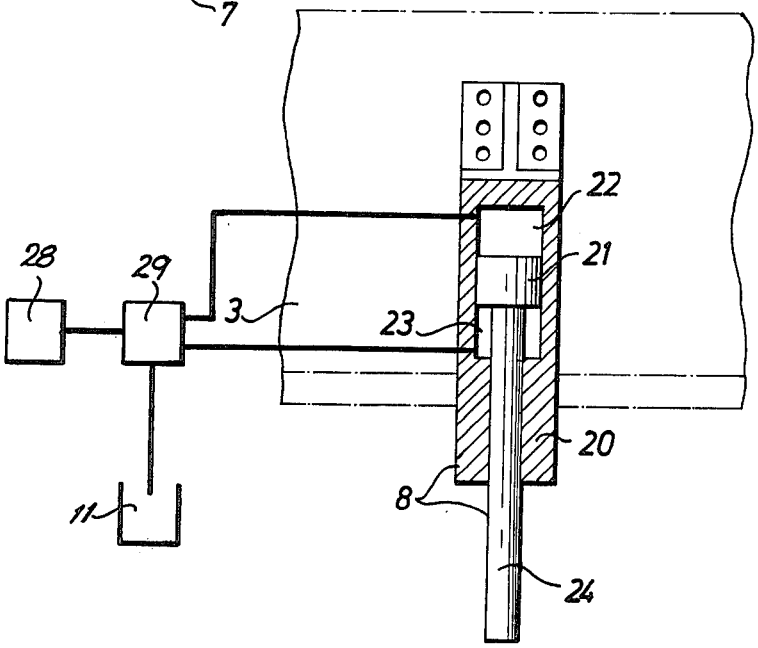
FIG. 5 shows an embodiment of a pressure device the length of which is adjustable during the pressing operation.

FIG. 5 illustrates a construction of the actuator devices 8 having a length which is adjustable during the pressing operation or before press closing as desired. The cylinder body 20 which is secured to the movable press table 3 contains a piston 21 with a piston rod 24 and defines with these elements two compartments 22, 23 which are pressurized in alternating order of sequence by means of the pump 28 via the directional valve 29, so that the piston is caused to take up one or the other of two well defined end positions in the cylinder body 20.

The pressing of material is accomplished in the following manner. After the material has been fed into the press, the pumps 13 (FIG. 1) are started and the press starts to close. When the press table 3 has reached the preset distance from the press table 5, the valves 7 and actuator devices 8 contact to set the valves 7 so that the valves and the cylinders 1 are connected to the conduit 10. If the pressing in this phase of the press cycle shall be performed to a thickness which is less than the value of the valves 7 are adjusted to, the valve 12 is used to prevent the pressure oil from flowing into the reservoir 11. When the valve 12 is opened, hydraulic fluid may flow from the cylinders 1 to the reservoir 11 and the spring back of the material that was pressed will raise the press table to the working position of the valves 7.

When pressing material, the thickness of which is changing during the press cycle, e.g. through crimping or swelling, the desired surface pressure on the material to be pressed and contact between the press platens of the press tables and the material for the desired heat transfer thereto may be maintained through resetting of the actuator devices 8. If the press, having the pump 13, also has a hydraulic source 15 or 17, respectively, common to all the cylinders 1, this may be dimensioned so that the closing time of the press becomes short. When the part of the press cycle occurs when the thickness of the material is controlled by actuation or opening of the valves 7, the cylinders 1 or the groups of cylinders are disconnected from the common hydraulic system and start to work independently of each other in that the valves 14 close (FIG. 3) or in that they are separated by means of the valve 16 at the cut-off of the hydraulic source 17 (FIG. 4). Then the cylinders 1 are supplied with hydraulic fluid by their pumps 13, the capacity of which could be less than that of the common system since merely the leakage flow has to be compensated. The cylinders 1 or the groups of cylinders have to work separated during this phase. Otherwise the thickness controlling characteristics of the valves 7 would not function.

When the pressure decreases at the end of the press cycle, the cylinders 1 are connected with each other by the opening of the valves 14 for balancing of the pressure differences. The hydraulic system, for press opening, is connected to the reservoir 11 whereby the flow of hydraulic fluid produces a pressure decrease.

In an embodiment according to FIG. 4, the cylinders 1 are connected to the reservoir 11 by means of valve adjustment in the system 19. Then hydraylic fluid flows through the valves 18 to the reservoir and the pressure is balanced gradually between the cylinders or groups of cylinders as the pressure decreases in the system 19 common for the cylinders 1. The press is opened when the return cylinders 25 are put under pressure.

The rod 24 may be dsigned, for instance, as a screw instead of a hydraulic piston and be driven by a motor which may be common to several pressure means 8.

While several complete embodiments of the invention have been disclosed herein, it will be appreciated that modification of these particular embodiments of the invention may be resorted to without departing from the scope of the invention.

What is claimed is:

1. In a single or multi-opening, multi-cylinder hydraulic press for pressing of resilient material between two operating press surfaces, an arrangement for maintaining the relative spacing of the press surfaces at a predetermined value greater than the minimum value of said spacing during the pressing operation, and characterized by further comprising for each press cylinder (1) or each group of press cylinders, liquid supplying means (13) and, a liquid discharge valve (7) and actuating means (8) operably positioned in association with the press surfaces for mechanically opening the valve as, within the operating range of the cylinder, the relative spacing of said operating press surfaces decreases below a predetermined value, and, for each press cylinder (1) or for a plurality of cylinders in common, a valve (12) adapted to prevent or allow liquid to be discharged from the cylinder or cylinders (1).

2. The arrangement as claimed in claim 1 characterized by further comprising, for each press cylinder (1) or group of press cylinders, the liquid supplying means including: a hydraulic system (17) common to a plurality, preferably all, of the press cylinders, and a non-return valve 6 positioned to allow liquid to be supplied from the hydraulic system to the press cylinders.

3. The arrangement as claimed in claim 1 characterized by further comprising for each press cylinder (1) or group of press cylinders: a valve system (19) common to a plurality, preferably all, of the press cylinders, a non-return valve (18) connecting to the valve system (19) to permit branching of liquid to the valve system (19) for lowering the operating pressure and for opening the press.

4. The arrangement as claimed in claim 1 characterized by further comprising for each press cylinder or group of press cylinders: a control valve (14) adapted to allow or alternatively to prevent any liquid flow to or from a hydraulic system common to a plurality, preferably all, of the press cylinders.

5. The arrangement as claimed in claim 1 characterized in that the actuating means disclosed in claim 1 includes a piston, piston rod, and cylinder device that has its piston rod protruding from the cylinder and be adjustable in length during the pressing operation.

6. The arrangement as in claim 5 where controllable fluid pressure supply means connect to opposite ends of the cylinder to selectively force the piston to the opposite end of the cylinder and adjust the protruding length of the piston rod.

* * * * *